US006604952B2

(12) United States Patent
Miwa et al.

(10) Patent No.: US 6,604,952 B2
(45) Date of Patent: Aug. 12, 2003

(54) PRINTED CIRCUIT BOARD CONNECTOR

(75) Inventors: Takeya Miwa, Shizuoka-ken (JP); Toru Kurosawa, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/777,891

(22) Filed: Feb. 7, 2001

(65) Prior Publication Data

US 2001/0023142 A1 Sep. 20, 2001

(30) Foreign Application Priority Data

Mar. 17, 2000 (JP) ..... P2000-076285

(51) Int. Cl.[7] ..... H01R 12/00
(52) U.S. Cl. ..... 439/79; 439/942
(58) Field of Search ..... 439/79, 80, 81, 439/83, 942

(56) References Cited

U.S. PATENT DOCUMENTS 4,550,962 A 11/1985 Czeschka
4,857,017 A 8/1989 Erk
4,955,819 A 9/1990 Harting et al.
5,252,080 A * 10/1993 Pesson ..... 439/79
5,346,404 A * 9/1994 Shimada ..... 439/108
5,453,016 A 9/1995 Clark et al.
5,639,249 A * 6/1997 Lenoir ..... 439/79
5,688,129 A * 11/1997 Flaherty ..... 439/79
5,785,537 A 7/1998 Donahue et al.

FOREIGN PATENT DOCUMENTS

JP 4-69859 6/1992
JP 10-172643 6/1998

* cited by examiner

*Primary Examiner*—Tho D. Ta
*Assistant Examiner*—James R. Harvey
(74) *Attorney, Agent, or Firm*—Finnegan, Henderson, Farabow, Garrett & Dunner, L.L.P.

(57) ABSTRACT

A printed circuit board connector 10 has a plurality of terminals 3 which connect the connector 10 to a printer circuit board and protrude outside from a rear wall surface 12*a* of a connector housing 12. Tip end portions of the terminals are bent into an L shape in parallel to the rear wall surface 12*a* and thereby aligned. A terminal cover 20 is detachably attached to the connector housing 12 so as to cover the terminals 3 and a tip end of an insulating wall 22 provided on the terminal cover 20 is fitted into a groove 15 formed in the rear wall surface 12*a*, whereby distances among adjacent terminals 3 can be widened and the insulation performance among the terminals 3 can be enhanced.

3 Claims, 3 Drawing Sheets

PRINTED CIRCUIT BOARD CONNECTOR

BACKGROUND OF THE INVENTION

1. Field of the Invention

The present invention relates to a connector for a printed circuit board connecting an opposite connector to the printed circuit board by attaching the connector to the printed circuit board.

2. Description of the Related Art

As connectors attached to printed circuit boards, there is known a connector shown in FIG. 1. This connector 1 consists of a connector housing 2 and a plurality of terminals 3. The front surface side (the other side in FIG. 1) of the connector 1 is connected to an opposite connector and the terminals 3 for connecting the connector 1 to the printed circuit board protrude from the rear surface side of the connector 1. One end portion of each terminal 3 fitted into the terminal of the opposite connector is located inside of the connector housing 2 and the other end portion thereof protrudes outside from the rear wall surface 2*a* of the connector housing 2.

The other end portion of each terminal 3 protruding outside, protrudes perpendicularly from the rear wall surface 2*a*, bends into an L shape parallel to the rear wall surface 2*a* and extends in the bottom direction of the connector housing 2. The aligned tip ends of the terminals 3 are connected to the conductor of the printed circuit board, whereby the connector 1 can be attached to the printed circuit board.

Meanwhile, if the above-stated connector 1 is used in a high-voltage current circuit, the distances among adjacent terminals are insufficiently short and the insulation performance among the terminals disadvantageously deteriorates. This is because the distances among adjacent terminals 3 are restricted so that the terminals 3 connected to the printed circuit board are arranged linearly. In addition, since the L-shaped terminals 3 are exposed outside, the terminals 3 tend to be bent by an external force. If bent, it becomes disadvantageously difficult to carry out an operation for attaching the terminals 3 to the printed circuit board.

SUMMARY OF THE INVENTION

It is, therefore, an object of the present invention to provide a printed circuit board connector capable of enhancing the insulation performance among terminals and preventing the terminals from being bent.

The first aspect of the invention provides a printed circuit board connector comprising: a connector housing; a plurality of the terminals each protruding outside from a rear wall surface of the connector housing, having a tip end portion bent into an L shape in parallel to the rear wall surface and thereby aligned; and a terminal cover detachably attached to the connector housing so as to cover the terminals protruding from the rear wall surface of the connector housing, and insulating the terminals from one another by an insulating wall provided on the terminal cover.

According to this invention, the terminal cover is attached to the connector housing only if necessary, so that the insulating wall of the terminal cover can enhance the insulation performance among the terminals and it is possible to protect the terminals.

According to the second aspect of the invention, there is provided a printed circuit board connector according to the first aspect of the invention wherein a groove is formed on the rear wall surface of the connector housing, and a tip end of the insulating wall is fitted into the groove.

According to this invention, the tip end of the insulating wall protruding from the terminal cover is fitted into the groove formed on the rear wall surface of the connector housing. Thus, it is possible to eliminate a gap between the insulating wall and the connector housing and to ensure insulating the terminals from one another up to the roots thereof.

According to the third aspect of the invention, there is provided a printed circuit board connector according to the first aspect of the invention wherein an engagement protrusion for restricting positions of the terminals by being engaged with the terminals, is provided on a wall surface of the insulating wall.

According to this invention, the positions of the terminals are restricted by engagement protrusions provided on the wall surface of the insulating wall. Thus, it is possible to maintain the arrangement of the terminals in a correct state.

According to the fourth aspect of the invention, there is provided a printed circuit board connector according to the first aspect of the invention wherein locking protrusions are provided on left and right wall surfaces of the connector housing, respectively and locking arms are provided on both sides of the terminal cover, respectively; and connecting the connector housing to the terminal cover is secured by engaging the locking protrusions with the locking arms.

BRIEF DESCRIPTION OF THE DRAWINGS

FIG. 2A is a perspective view showing a state before a terminal cover is attached to a connector housing and FIG. 2B is a perspective view showing the internal constitution of the terminal cover; FIG. 3A is a perspective view showing a state in which the terminal cover has been attached to the connector housing and FIG. 3B is a cross-sectional view along line IIIB—IIIB of FIG. 3A.

DETAILED DESCRIPTION OF THE PREFERRED EMBODIMENT

Figure 1:
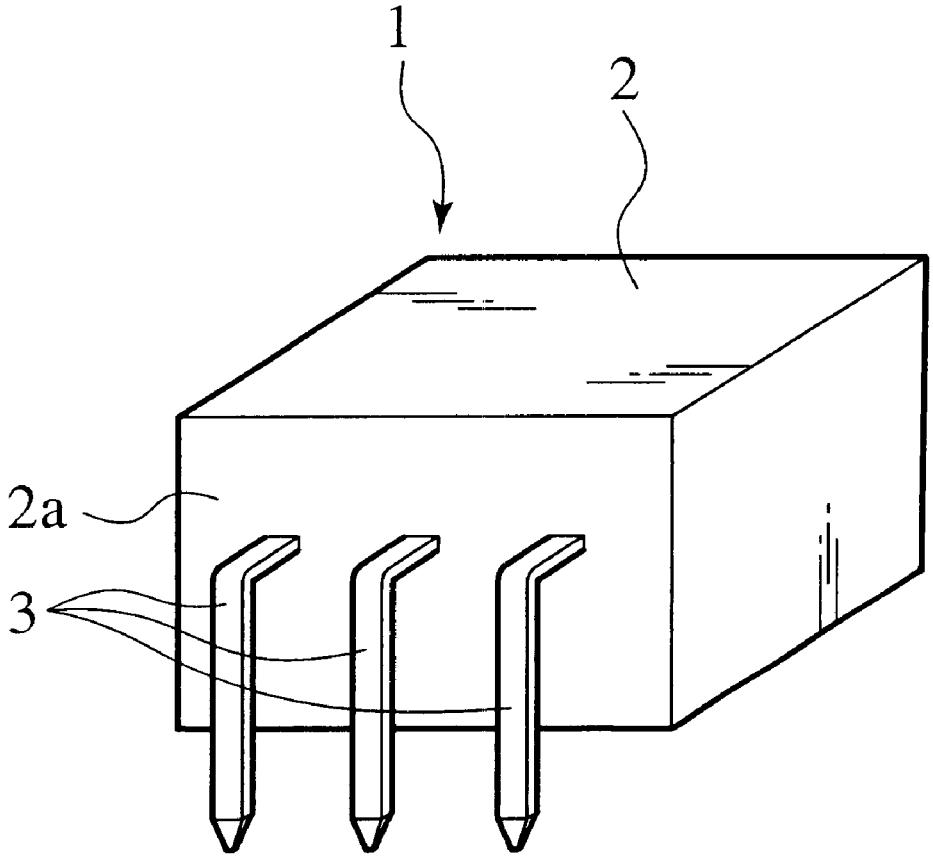
FIG.1 PRIOR ART
FIG. 1 is a perspective view of a conventional printed circuit board connector.
Figure 2A:
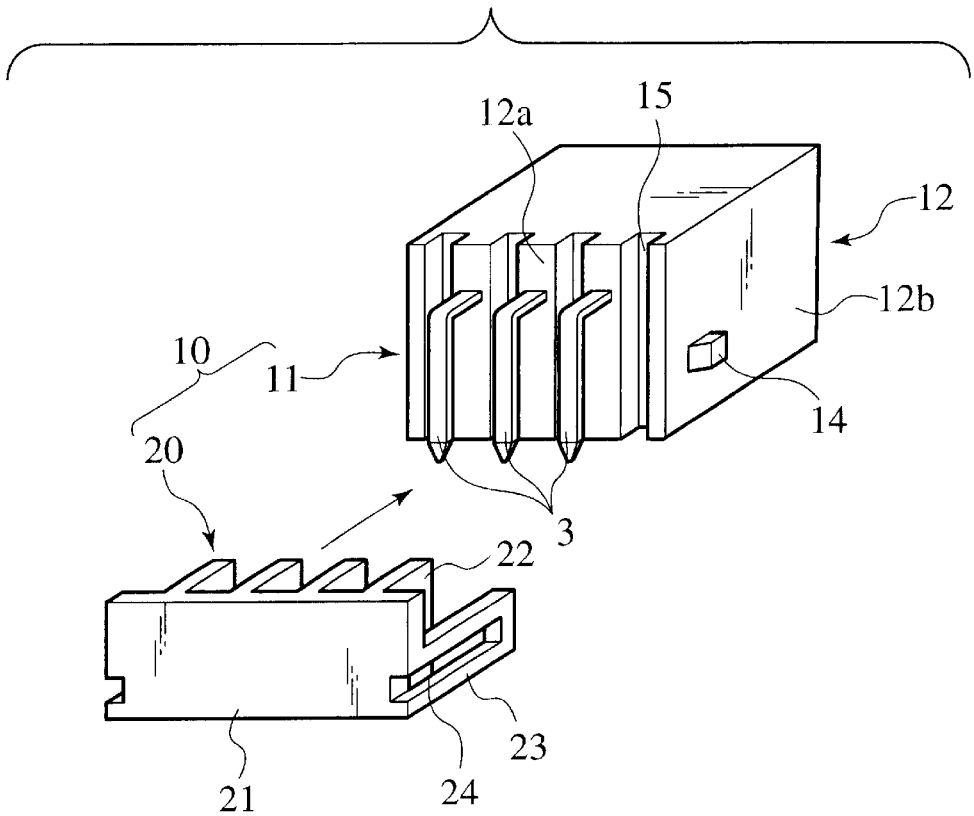
FIGS. 2A and 2B are block diagrams of a printed circuit board connector in one embodiment according to the present invention, where
Figure 2B:
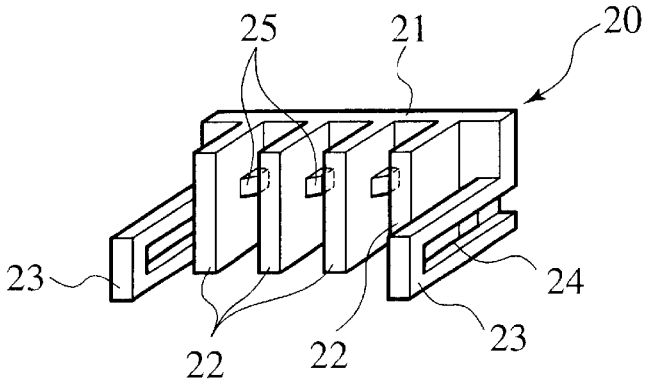

One embodiment of the present invention will be described hereinafter with reference to the drawings.

The printed circuit board connector 10 shown therein comprises a connector body 11 and a terminal cover 20 attached to the connector body 11 at need.

The connector body 11 comprises a connector housing 12 and a plurality of terminals 3. The front surface side (the other side in the drawings) of the connector body 11 is connected to an opposite connector and the terminals 3 for connecting the connector 10 to a printed circuit board protrude on the rear surface of the connector body 11. One end portion of each terminal 3 fitted into the terminal of the opposite connector is located inside the connector housing 12 and the other end portion thereof protrudes outside from the rear wall surface 12*a* of the connector housing 12.

The other end portion of each terminal 3 protruding outside, protrudes perpendicularly from the rear wall surface 12*a*, bends into an L shape in parallel to the rear wall surface 12*a* and extends in the bottom direction of the connector housing 12. The aligned tip ends of the terminals 3 are connected to the conductor of the printed circuit board, whereby the connector body 11 can be attached to the printed circuit board.

Figure 3A:
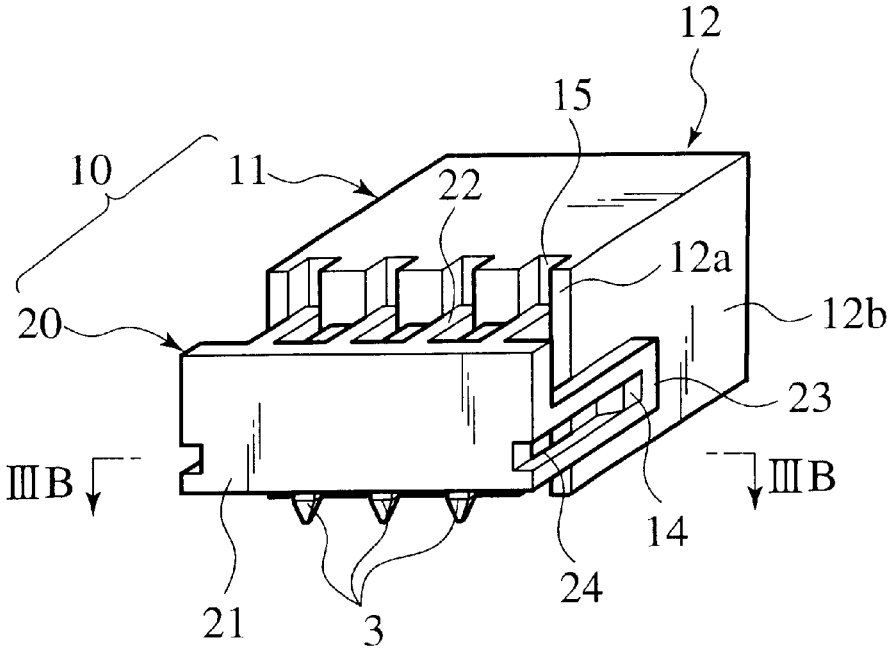
FIGS. 3A and 3B are block diagrams of the printed circuit board connector in the embodiment according to the present invention, where
Figure 3B:
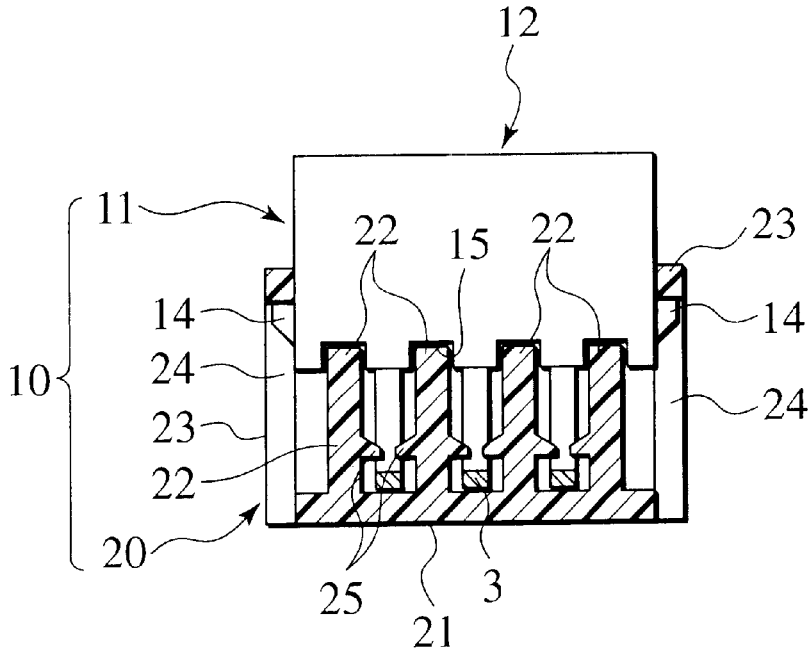

The constitution of the connector body 11 described above is the same as that of the conventional connector 1 shown in FIG. 3. The connector body 11 differs from the conventional connector 1 in that a groove 15, which is located between the terminals 3 aligned sideways and which longitudinally extends, is provided in the rear wall surface 12*a* and that a locking protrusion 14 for fixing the terminal cover 20 is provided on the side wall surface 12*b* of the connector housing 12.

On the other hand, the terminal cover 20 is detachably attached to the connector housing 12 so as to cover the terminals 3. The terminal cover 20 has a cover wall 21 facing to the rear wall surface 12 at a certain distance when attaching the terminal cover 20 to the connector housing 12, a plurality of insulating walls 22 provided on the inner surface of the cover wall 21 and insulating adjacent terminals 3, and a pair of locking arms provided on right and left sides of the cover wall 21, respectively.

An engagement protrusion 25, which restricts the positions of the terminals 3 by being engaged with the terminals 3 when attaching the terminal cover 20 to the connector housing 12, is provided on the terminal 3—sidewall surface of each insulating wall 22. Further, a locking hole 24 engaged with the locking protrusion 14 is provided in each locking arm 23.

To attach the terminal cover 20 to the connector body 11, the terminal cover 20 is arranged to cover the terminals 3, the locking arm 23 is slid on the side wall surface 12*b* and the locking hole 24 is engaged with the locking protrusion 14. At the same time, the tip ends of the insulating walls 22 are fitted into the groove 15 of the rear wall surface 12*a*, thereby insulating the adjacent terminals 3 from one another.

If the terminal cover 20 is attached to the connector body 11 as stated above, the engagement protrusions 25 provided on the wall surfaces of the insulating walls 22 are engaged with the terminals 3, thereby holding the respective terminals at fixed positions. Therefore, the terminal cover 20 can protect the terminals 3 from being applied with an external force and maintain the terminals 3 in a correct arrangement state. As a result, the connector 10 can be attached to the printed circuit board more easily and attachment failure can be prevented.

Moreover, since the insulating walls 22 exist among the terminals 3, the distances among the adjacent terminals 3 are widened, so that the insulation performance among the adjacent terminals 3 is enhanced. Especially, since the tip ends of the insulating walls 22 are fitted into the groove 15 of the connector housing 12, it is possible to ensure insulating the terminals 3 from one another up to the roots thereof.

What is claimed is:

1. A printed circuit board connector comprising:

a connector housing having a rear wall surface with a plurality of grooves spaced away from each other;

a plurality of terminals respectively protruding from said rear wall surface between the grooves, each of the terminals being of inverted L-shaped configuration to define one leg portion normal to the rear surface and another leg portion parallel to the rear surface; and a terminal cover detachably attached to said connector housing so as to cover said terminals protruding from said rear wall surface of said connector housing, and having a plurality of insulating walls, each of the walls is located respectively between said terminals for insulating said terminals from one another, wherein each of the walls is received in one of the corresponding said grooves.

2. A printed circuit board connector according to claim 1, wherein engagement protrusions for restricting positions of said terminals by being engaged with said terminals, is provided on a wall surface of said plurality of insulating walls.

3. A printed circuit board connector according to claim 1, wherein locking protrusions are provided on left and right wall surfaces of said connector housing, respectively and locking arms are provided on both sides of said terminal cover, respectively; and connecting said connector housing to said terminal cover is secured by engaging said locking protrusions with said locking arms.

* * * * *